US007578306B2

(12) United States Patent
Mettavant

(10) Patent No.: US 7,578,306 B2
(45) Date of Patent: Aug. 25, 2009

(54) SELF-DEPLOYABLE TENT INCLUDING AN INSIDE CHAMBER

(75) Inventor: Benjamin Mettavant, Saint Gervais (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 12/081,649

(22) Filed: Apr. 18, 2008

(65) Prior Publication Data

US 2008/0190473 A1 Aug. 14, 2008

Related U.S. Application Data

(63) Continuation of application No. 10/565,802, filed as application No. PCT/FR2004/003220 on Dec. 14, 2004, now abandoned.

(30) Foreign Application Priority Data

Nov. 17, 2004 (FR) ..... 04 12210

(51) Int. Cl.
*E04H 15/40* (2006.01)

(52) U.S. Cl. ..... 135/126; 135/137; 135/156; 135/119

(58) Field of Classification Search ..... 135/124–126, 135/128, 137, 156, 905–907, 119, 136
See application file for complete search history.

(56) References Cited

U.S. PATENT DOCUMENTS 3,960,161 A * 6/1976 Norman ..... 135/126
3,970,096 A * 7/1976 Nicolai ..... 135/94
4,165,757 A * 8/1979 Marks ..... 135/93
5,137,044 A * 8/1992 Brady ..... 135/126
5,163,461 A * 11/1992 Ivanovich et al. ..... 135/126
5,337,772 A * 8/1994 Habchi ..... 135/125
5,421,355 A * 6/1995 Cantwell ..... 135/120.3
5,601,105 A * 2/1997 Blen et al. ..... 135/126
5,645,096 A * 7/1997 Hazinski et al. ..... 135/126
5,676,168 A * 10/1997 Price ..... 135/126
6,145,527 A * 11/2000 Gillis ..... 135/124
6,216,715 B1 * 4/2001 Howe ..... 135/95
6,470,901 B1 * 10/2002 Scherer ..... 135/136

FOREIGN PATENT DOCUMENTS

DE 3213781 A1 * 2/1983
JP 03021779 A * 1/1991

* cited by examiner

*Primary Examiner*—Winnie Yip
(74) *Attorney, Agent, or Firm*—Kenyon & Kenyon LLP

(57) ABSTRACT

The self-deployable tent comprises:

a hoop structure comprising a base loop (2) and at least one top loop (3); and a roof sheet (5) secured to the base loop (2) and to the top loop (3).

The tent further includes an inside chamber (6) disposed beneath the roof sheet (5), and having a top portion (6*a*) that is secured to the top loop (3) by flexible spacer means (8), and a bottom portion that is secured to the base loop (2). In the deployed position, the tension in the roof sheet (5) and the inside chamber (6) is such that they are held apart from each other by the spacer means (8).

19 Claims, 2 Drawing Sheets

SELF-DEPLOYABLE TENT INCLUDING AN INSIDE CHAMBER

CROSS-REFERENCE TO RELATED APPLICATIONS

This application is a continuation of U.S patent application Ser. No. 10/565,802 filed Apr. 13, 2006, now abandoned which is a 371 national phase application of PCT/FR2004/03220 filed Dec. 14, 2004, claiming priority to French Application No. 0412210 filed Nov. 17, 2004, the entire contents of which are incorporated herein by reference.

The present invention relates to a self-deployable tent, i.e. a tent presenting a structure of flexible hoops secured to the roof sheet, said tent being capable of being folded in a minimum storage configuration that is circular and flat merely by deforming the hoop structure, and being capable of deploying in volume in the usual configuration for a tent merely on releasing the deformation stresses on the hoop structure. The invention relates more particularly to a self-deployable tent that is fitted with an inside chamber.

DETAILED DESCRIPTION

By way of example, U.S. Pat. No. 3,990,463 discloses a hoop-structure tent in which the hoop is in the form of a continuous loop of flexible and deformable material that can be folded into the form of a loop of smaller size, and which presents a spring effect. The hoop structure is secured to at least one roof sheet, and possibly also to a ground sheet. In FIG. 1 of U.S. Pat. No. 3,990,463, there can clearly be seen a flexible hoop structure forming a top loop that defines how the tent deploys. For such deployment to be complete, it is nevertheless important to secure the roof sheet to the ground by exerting traction on the four corners of the roof sheet. In this respect, the tent of U.S. Pat. No. 3,990,463 is not totally self-deployable since deployment of the tent requires manual intervention on the part of the operator. FIGS. 5 to 10 of that document show the procedure for folding the tent so as to obtain the folded, spring-effect configuration for the hoop structure.

A tent that is totally self-deployable, and that does not require manual intervention in order to obtain final deployment, is known for example from U.S. Pat. No. 5,163,461. According to that document, the hoop structure comprises not only a top loop, but also a base loop, itself secured to the roof sheet, said base loop defining the periphery of the roof sheet. In that document, the hoop structure is continuous, being constituted by a succession of flexible rods connected to one another and having certain portions that, in the deployed state, form the top loop, and other portions that, in the deployed state, form the base loop. Furthermore, that document also provides that in addition to the base loop, there may be a plurality of top loops, the loops being symmetrical relative to one another about a transverse midplane of the base loop.

In European patent No. 0 857 245, the flexible rods connected to one another to form the base loop and the top loop are connected by means of a dual connector located in the region of the transverse midplane. Nevertheless, in that document, provision is also made for an additional hoop structure of conventional dome-shaped configuration for extending over the top loop and fixed along the opposite edges of the base loop in order to form a frame outside a tent.

In the field of tents, in order to limit the discomfort of condensation, it is also known to place an inside chamber beneath the roof sheet proper under conditions that enable a space to be formed between the roof sheet and the inside chamber, which space is suitable for establishing an intermediate layer of air. In a conventional tent of structure formed by vertical poles, the spacing between the roof sheet, possibly referred to a double roof, and the inside chamber is obtained by spacers placed at the tops of the poles after the inside chamber or tent sheet has been put into place.

When the tent is deployed by means of a structure made up of interfitting tubes or by a hoop structure, the roof sheet is placed over said structure, and under such circumstances, the inside chamber can be secured under the tubular or hoop structure, generally by means of hoops.

The same can naturally apply when the hoop structure is not of conventional type, but is that of a self-deployable tent as described above. Thus, putting the inside chamber into place requires the user to perform additional operations that deprive the self-deployable tent of its prime advantage, i.e. that of requiring no handling operations while it is being set up, other than securing it to the ground.

The object of the present invention is to mitigate that drawback by proposing a self-deployable tent provided with an inside chamber that does not require such handling operations.

This object is fully achieved by a self-deployable tent which, in conventional manner, comprises a structure of flexible hoops including a base loop and at least one top loop together with a roof sheet that is secured to the base and top loops.

In characteristic manner, according to the present invention, the self-deployable tent further comprises an inside chamber placed under the roof sheet, said chamber having a top portion that is secured to the top loop by flexible spacer means, and a bottom portion that is secured to the bottom loop. In the deployed position, the tension of the roof sheet and of the inside chamber is such that they are held apart from each other by the spacer means.

It is thus firstly the respective dimensions of the roof sheet and of the inside chamber, secondly the respective dimensions of the base loop and of the top loop(s), and thirdly the presence of the flexible spacer means that make it possible, in the deployed position, to ensure that the inside chamber presents a substantially tensioned configuration defining a layer of air under the roof sheet, with this being achieved merely by the tent deploying, and without requiring any additional handling operation on the part of the user.

In a variant embodiment, the roof sheet includes two openings in its bottom portion, in particular opposite openings, forming inlets/outlets for air leading to and from the layer of air between the roof sheet and the top portion of the inside chamber. This layer of air then becomes a ventilation space, since air can flow freely therethrough. Each of these two opposite openings is preferably formed in the inside zone of a top loop, close to the base loop. Naturally, these opposite openings formed through the roof sheet may optionally be provided with respective grids or textile netting, providing there remains sufficient permeability to air in said opening to achieve the desired ventilation effect.

In a first embodiment, the bottom portion of the inside chamber constitutes the ground sheet of the tent.

In a second embodiment, a ground sheet is provided that is secured to the base loop or to the roof sheet or to the chamber, and that is independent from the bottom portion of the inside chamber. Thus, under such circumstances, there are two superposed layers forming the bottom of the tent, one, the ground sheet, being in direct contact with the ground, and the other, the bottom portion of the inside chamber, being in contact with the user. This particular disposition makes it possible to have a wide variety of choice in determining the material suitable for constituting each of said two layers, depending on the looked-for technical properties. The layer in contact with the ground needs to present properties of insulation and of waterproofing; the layer in contact with the user must be more comfortable. By separating these properties into two superposed layers, it is also possible to make use of materials that are more conventional and thus less expensive, and it is also possible to obtain overall better thermal insulation from the ground.

In a variant embodiment, the self-deployable tent of the invention includes sheaths that are fitted to the outside face of the roof sheet or that are integrated in said roof sheet, in order to pass the top loop of the hoop structure. Under such circumstances, the flexible spreader means are themselves secured to the inside face of the roof sheet at or close to said sheaths. Thus, the inside chamber is tensioned via the flexible spacer means in the regions of the roof sheet that are themselves put under tension by the top loop.

The flexible spacer means may be of a very wide variety of types. They may be textile strips sewn directly to the roof sheet and to the inside chamber, or there may even be a direct connection in the form of stitching between the roof sheet and the inside chamber. There may be removable fasteners which are connected to fastener elements themselves permanently secured to the inside face of the roof sheet and to the outside face of the inside chamber. This fastener disposition makes it easier to make the tent because the inside chamber is not permanently connected to the roof sheet, in particular there is no stitching between them.

In a variant embodiment, the self-deployable tent of the present invention also includes means for adjusting the width of the tent, said means extending between two opposite zones both of the base loop and of the top loop beneath the bottom portion of the inside chamber. For example, these adjustment means may be constituted by a simple textile strip whose ends are wound around the base loop and the bottom portion of the top loop and that are secured by appropriate means, e.g. a self-gripping closure system based on hooks and loops. This makes it possible to define the width of the tent and thus to modulate its volume.

The present invention can be better understood on reading the following description of an embodiment of a self-deployable tent provided with an inside chamber surrounded by a ventilation space, as shown in the accompanying drawings, in which:

DETAILED DESCRIPTION OF THE DRAWINGS

The self-deployable tent in the example described below comprises a hoop structure constituted by a plurality of flexible rods presenting elastic return, in particular being constituted by canes of composite or metal or plastics material, said rods being connected to one another so as to form a base loop 2 and a top loop 3. This may be constituted by a continuous assembly of rods connected to one another so as to form both the base loop and the top loop, as described in U.S. Pat. No. 5,163,461. It is also possible for there to be two sets of rods connected to one another so as to form two independent loops, i.e. the base loop 2 and the top loop 3.

Figure 1:
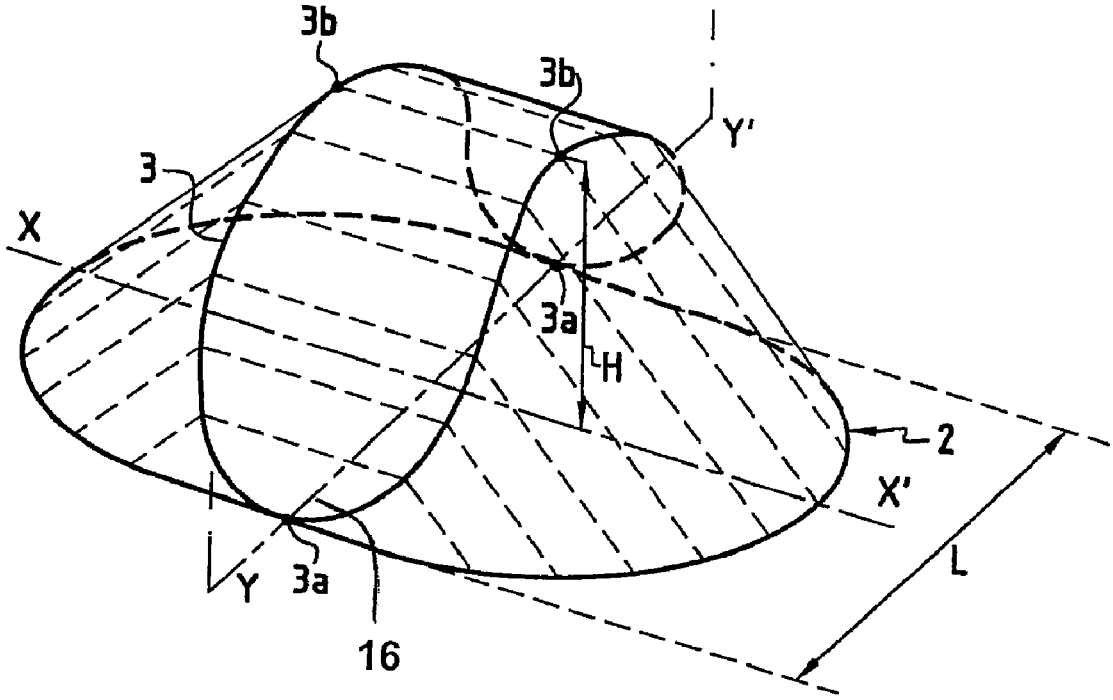
FIG. 1 is a diagrammatic perspective view of the hoop structure of the tent, shown in the deployed position.

The base loop 2 defines the ground surface of the tent, adjacent to the outside periphery thereof. In the deployed position, this base loop 2 occupies a plane configuration of circular or oblong shape. FIG. 1 shows the two axes of symmetry of the base loop, respectively a longitudinal axis XX' and a transverse axis YY'.

The top loop 3 defines the height and the inside volume of the tent. When the tent is in the deployed position, the bottom portions 3*a* of the top loop 3 are in the immediate vicinity of the base loop 2 on the transverse axis YY', while the top portions 3*b* of the top loop are vertically above the longitudinal axis XX' of the base loop 2.

The hoop structure of the self-deployable tent of the present invention may optionally include other top loops for the purpose of forming the volume of the tent, for example loops of the kinds described in U.S. Pat. Nos. 5,163,461, 5,385,165, or 5,396,917.

The hoop structure serves to support firstly a roof sheet 5 and secondly an inside chamber 6. In a non-limiting roof sheet, the hoop structure is housed in sheaths 7 in the form of textile strips folded over and sewn to the outside face of the roof sheet 5.

These sheaths 7 may be continuous or discontinuous, or they may be in the form of rings of small dimensions.

Instead of sheaths that project out from the roof sheet, the sheaths could be integrated in the structure of the roof sheet in the form of pockets or cases constituted by a localized area of the roof sheet having two walls.

The inside chamber 6 is disposed under the roof sheet 5. It presents a top portion 6*a* that is secured to the top loop 3 by flexible spacer means 8, and a bottom portion 6*b* that is secured to the bottom loop 2, optionally, but not necessarily, by flexible spacer means.

Figure 2:
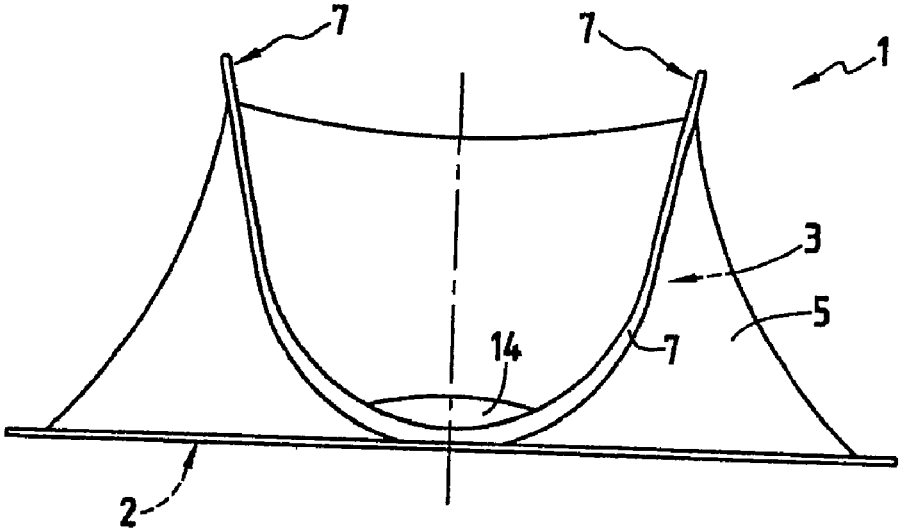
FIG. 2 is a diagrammatic side view of the self-deployable tent.
Figure 3:
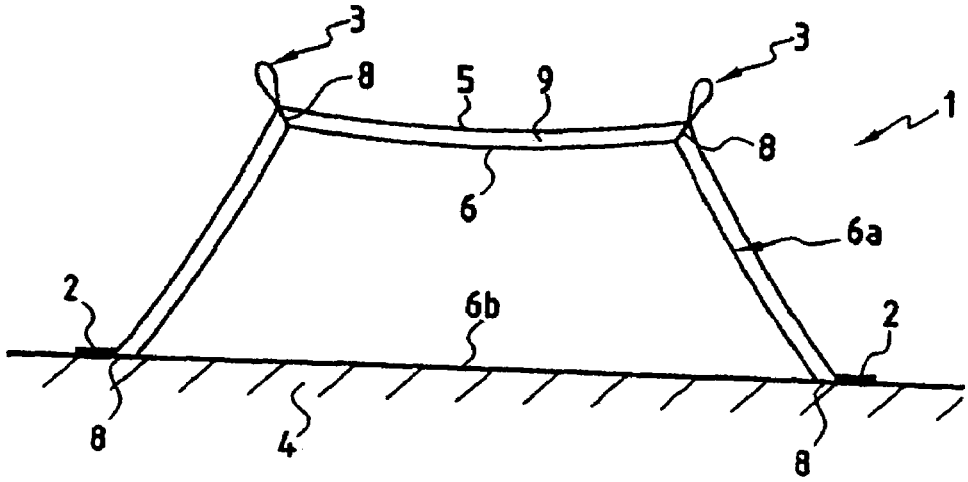
FIG. 3 is a diagrammatic longitudinal section view of the FIG. 2 tent.

The dimensions of the base loop 2 and of the top loop 3, the dimensions of the roof sheet 5 and of the inside chamber 6, and the dimensions of these flexible spacer means are determined in such a manner that when the hoop structure passes from its folded position to its deployed position, the tent takes up the configuration shown in FIGS. 2 and 3, the roof sheet 5 being tensioned and the inside chamber 6 being suspended beneath the roof sheet 5, likewise with a certain amount of tension, leaving a layer of air in the space 9 that remains available between the inside face of the roof sheet 5 and the outside face of the inside chamber 6. In addition, the bottom portion 6*b* of the inside chamber 6 lies substantially level with the ground 4.

Figure 5:
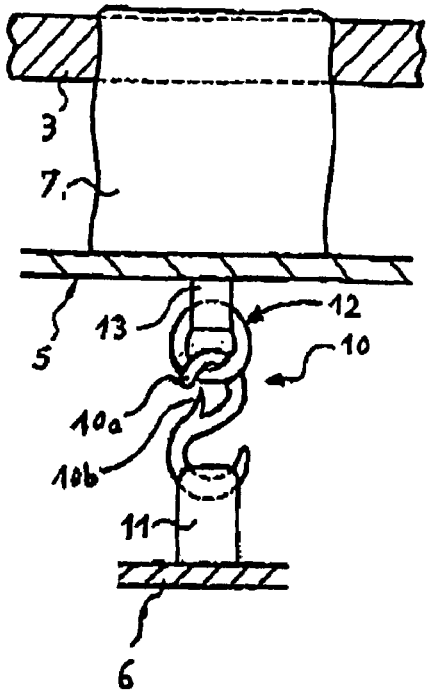
FIG. 5 is a diagram showing detachable flexible spacer means.

One example of flexible spacer means is shown in FIG. 5. This example comprises releasable means, enabling the roof sheet 5 and the inside chamber 6 to be assembled together and to be separated. In the example shown in FIG. 5, the flexible spacer means comprise a system made up of a hook 10 secured to the inside chamber 6 by a closed annular part 12 that is secured to the roof sheet 5 via a textile tab 13. It thus suffices to engage the free end 10*a* of the hook 10 into the annular part 12 so as to obtain the desired assembly and maintain a certain amount of spacing between the roof sheet 5 and the inside chamber 6 due to the tensioning and the weight of the inside chamber 6 tending to keep the textile tabs 11 and 13 extended. In the example shown in FIG. 5, the hook 10 includes a flexible locking barb lob disposed close to the free end 10*a* of the hook 10 so as to enable the hook 10 to be inserted into the loop of the annular part 12, while preventing it from escaping therefrom unless the barb lob is manipulated.

As shown in FIG. 5, the flexible spacer means are preferably installed in the zone where the hoop structure is applied to the roof sheet. In the present example, the textile tab 13 connecting the roof sheet 5 to the annular part 12 is sewn in the fastening region for the sheath 7 that is used for receiving the top loop 3 of the hoop structure.

This embodiment of the flexible spacer means 8 is not exclusive, and any other structure could be envisaged provided it makes it possible firstly to achieve a flexible connection between the roof sheet and the inside chamber, and secondly to provide a certain amount of spacing between these two walls so as to establish an insulating space, i.e. a space that contains a layer of air.

The insulating space is preferably also a ventilation space, with openings 14 being provided in the bottom portion of the roof sheet 5. In the example shown in FIG. 2, there are two opposite openings disposed symmetrically about a vertical plane containing the longitudinal axis XX', said openings 14 being formed in the inside zone of the top loop that is located in the immediate vicinity of the base loop 2. Specifically, there are two lateral openings through which air can enter and leave in order to establish air circulation inside the entire space 9 left empty between the inside chamber and the roof sheet.

The positioning of these two openings 14 in this location presents the advantage of also giving access to an operator in order to adjust the fastening of the bottom portion 6*b* of the inside chamber 6 on the base loop 2 and the top loop 3, or even to adjust the width L of the tent, should that be necessary.

Figure 4:
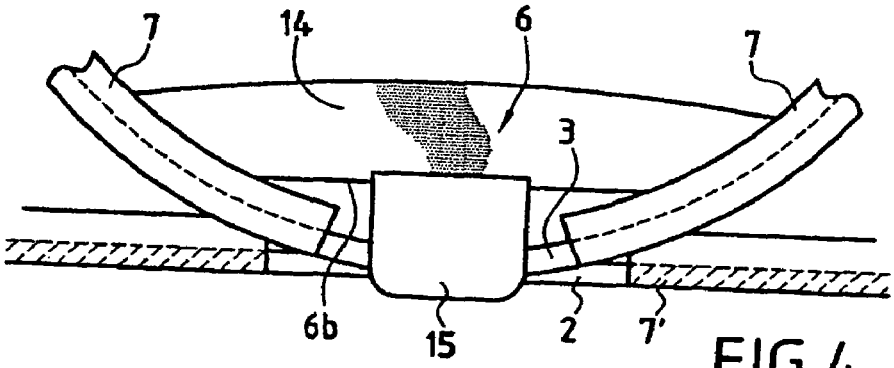
FIG. 4 is a fragmentary plan view of the FIG. 2 tent showing a lateral opening.

FIG. 4 is a view showing a fragment of FIG. 2 in perspective as seen from above, showing through the opening 14 to the bottom of the top portion 6*a* of the inside chamber 6, close to the bottom portion 6*b*, and secondly the base and top loops 2 and 3 of the hoop structure where they are close together. In the example shown in FIG. 4, the bottom portion 6*b* of the inside chamber 6 is connected to the base and top loops 2 and 3 by a fastener sleeve 15 formed of two textile strips suitable for being looped together to form said sleeve 15, with the fastening being by means of a self-gripping type closure system having hooks and loops, as known under the name Velcro. This fastener sleeve 15 enables the inside chamber to be secured via it bottom portion 6*b* to the base loop 2 and also to the top loop 3, both of which are accessible through the opening 14 formed in this region and because of the fact that respective sheaths 7 for the top loop and 7' for the base loop are likewise interrupted in this region.

The fastener sleeve 15 made up of two portions that can be connected together by hook and loop elements also serve, to some extent, to vary the dimensions by adjusting the width L of the tent, i.e. by varying the spacing between the base and top loops 2 and 3 on the transverse axis YY' of the tent.

Normally it is the dimensions of the roof sheet and of the chamber that define the outside dimensions of the tent in all directions, because of the tensioning thereof by the base and top loops. Nevertheless, it should be observed that adjusting the width L necessarily influences the height H of the tent since deforming the bottom portion 3*a* of the top loop 3 will necessarily lead to a corresponding deformation of the top portion 3*b* of said loop 3. The width L of the tent can be adjusted by independent means, other than the above-described fastener sleeve 15, for example by a transverse strip 16 (FIG. 1) having its two ends connected to the bottom portions of the top loop 3 and also to the base loop 2 on the transverse axis YY', the transverse strip 16 preferably being provided with means for adjusting its length, possibly an integrated system using hooks and loops as in the above-described example for the fastener sleeve 15.

The bottom portion 6*b* of the inside chamber 6 can itself act as a ground sheet.

However, in another variant, provision is made for the ground sheet proper to be independent of the bottom portion of the inside chamber and to be secured to the base loop. The ground sheet could also be secured to the roof sheet or to the chamber, for example it could be sewn along the bottom edge of the roof sheet or to the top portion of the inside chamber. Whatever the configuration, this provides two layers of material forming the bottom of the tent, the bottom portion 6*b* of the inside chamber and the ground sheet proper. This disposition thus makes it possible to associate the technical properties that need normally to be performed by the two faces of a conventional ground sheet, where the top face, and thus in the present case the bottom portion 6*b* of the inside chamber, needs to feel agreeable when making contact with the user, while the bottom face and in this case the ground sheet proper, needs to present properties of insulation, abrasion resistance, and waterproofing in contact with the ground.

By way of example, in this embodiment, the bottom portion of the inside chamber can be made of a polyester fabric, while the ground sheet proper tensioned within the base loop 2 can be made from a coated polyamide fabric.

The looked-for ventilation effect serves to avoid excessive humidity in the layer of air between the inside chamber and the roof sheet due to a condensation effect. To achieve such ventilation, via the openings formed in the roof sheet, it is not absolutely essential for there to be a gap between the bottom wall 6*b* of the inside chamber 6 and the base loop 2, since the ventilation needs to be achieved mainly over the top portion 6*a* of the inside chamber 6.

The spacer means must be flexible in order to avoid impeding folding up of the tent so that it can be put into a bag for transport, and also so as to be capable of following the differences in respective positions of the roof sheet and of the inside chamber, e.g. due to an adjustment in the width of the tent.

The invention claimed is:

1. A self-deployable tent comprising: a hoop structure comprising a base loop and at least one top loop, each of the base loop and the top loop being made of a continuous assembly of flexible rod, the hoop structure having a folded position and being self-deployable in a deployed position; and a roof sheet secured to the base loop and the top loop, wherein: a) the tent further comprises an inside chamber disposed beneath the roof sheet, said chamber having a top portion secured to the top loop via flexible spacer means, and a bottom portion secured to the base loop; and, wherein: b) in the deployed position, a tension of the roof sheet and the inside chamber holds them apart from each other by the flexible spacer means.

2. A self-deployable tent according to claim 1, wherein the bottom portion of the roof sheet includes two opposite openings for inlet and outlet of air flowing in a ventilation space between the roof sheet and the inside chamber.

3. A self-deployable tent according to claim 2, wherein each of the two opposite openings is formed in the inside region of the top loop close to the base loop.

4. A self-deployable tent according to claim 3, wherein the bottom portion of the chamber constitutes the ground sheet of the tent.

5. A self-deployable tent according to claim 3, wherein the tent includes a ground sheet that is independent from the bottom portion of the inside chamber, and is secured to the base loop, or to the roof sheet, or to the chamber.

6. A self-deployable tent according to claim 3, wherein the tent includes sheaths fixed on or integrated in the outside face of the roof sheet to pass the top loop, wherein the flexible spacer means are secured to the inside face of the roof sheet at or close to said sheaths.

7. A self-deployable tent according to claim 3, wherein the flexible spacer means are releasable fasteners, and the inside face of the roof sheet and the outside face of the inside chamber carry fastener elements for fastening said fasteners.

8. A self-deployable tent according to claim 2, wherein the bottom portion of the chamber constitutes the ground sheet of the tent.

9. A self-deployable tent according to claim 2, wherein the tent includes a ground sheet that is independent from the bottom portion of the inside chamber, and is secured to the base loop, or to the roof sheet, or to the chamber.

10. A self-deployable tent according to claim 9, wherein the tent includes sheaths fixed on or integrated in the outside face of the roof sheet to pass the top loop, wherein the flexible spacer means are secured to the inside face of the roof sheet at or close to said sheaths.

11. A self-deployable tent according to claim 2, wherein includes sheaths fixed on or integrated in the outside face of the roof sheet to pass the top loop, wherein the flexible spacer means are secured to the inside face of the roof sheet at or close to said sheaths.

12. A self-deployable tent according to claim 2, wherein the flexible spacer means are releasable fasteners, and the inside face of the roof sheet and the outside face of the inside chamber carry fastener elements for fastening said fasteners.

13. A self-deployable tent according to claim 2, wherein the tent includes adjuster means for adjusting the width of the tent, extending between two opposite zones both of the base loop and of the top loop, beneath the bottom portion of the inside chamber.

14. A self-deployable tent according to claim 1, wherein the bottom portion of the chamber constitutes a ground sheet of the tent.

15. A self-deployable tent according to claim 14, wherein the flexible spacer means are releasable fasteners, and the inside face of the roof sheet and the outside face of the inside chamber carry fastener elements for fastening said fasteners.

16. A self-deployable tent according to claim 1, which includes a ground sheet that is independent from the bottom portion of the inside chamber, and is secured to the base loop, or to the roof sheet, or to the chamber.

17. A self-deployable tent according to claim 1, wherein the tent includes sheaths fixed on or integrated in the outside face of the roof sheet to pass the top loop, wherein the flexible spacer means are secured to the inside face of the roof sheet at or close to said sheaths.

18. A self-deployable tent according to claim 1, wherein the flexible spacer means are releasable fasteners, and the inside face of the roof sheet and the outside face of the inside chamber carry fastener elements for fastening said fasteners.

19. A self-deployable tent according to claim 1, wherein the tent includes adjuster means for adjusting the width of the tent, extending between two opposite zones both of the base loop and of the top loop, beneath the bottom portion of the inside chamber. integrated in the outside face of the roof sheet to pass the top loop, wherein the flexible spacer means are secured to the inside face of the roof sheet at or close to said sheaths.

* * * * *